US005372418A

United States Patent [19]

Biesenberger et al.

[11] Patent Number: 5,372,418

[45] Date of Patent: Dec. 13, 1994

[54] BACK MIX DRAG-FLOW APPARATUS

[75] Inventors: Joseph A. Biesenberger, Wayne; David B. Todd, Princeton, both of N.J.

[73] Assignee: Polymer Processing Institute, Hoboken, N.J.

[21] Appl. No.: 978,874

[22] Filed: Nov. 19, 1992

[51] Int. Cl.[5] ..... B01F 7/08; B01F 7/24

[52] U.S. Cl. ..... 366/85; 425/204; 366/301

[58] Field of Search ..... 366/83-85, 366/301, 297, 300; 425/204

[56] References Cited

U.S. PATENT DOCUMENTS

| | | | |
|---|---|---|---|
| Re. 23,948 | 2/1955 | Fuller | 18/12 |
| 498,206 | 5/1893 | Denbeigh | 366/83 |
| 731,073 | 6/1903 | Rust | 366/83 |
| 1,990,555 | 2/1935 | Loomis | 18/2 |
| 2,441,222 | 5/1948 | Fuller | 18/12 |
| 2,458,068 | 1/1949 | Fuller | 100/48 |
| 2,968,836 | 1/1961 | Colombo | 366/85 |
| 3,216,706 | 11/1965 | Loomans | 366/85 |
| 3,602,484 | 8/1971 | Poncet | 366/84 |
| 3,873,474 | 3/1975 | Ficker | 366/85 |
| 3,904,719 | 9/1975 | Fritsch | 425/204 |
| 3,907,259 | 9/1975 | Leclery | 366/85 |
| 4,057,376 | 11/1977 | Berger | 366/84 |
| 4,079,863 | 3/1978 | Bouyer | 222/413 |
| 4,214,862 | 7/1980 | Kolossow | 425/204 |
| 4,462,693 | 7/1984 | Buschbom | 366/300 |
| 4,617,089 | 10/1986 | Ullrich | 366/85 |
| 4,619,381 | 10/1986 | Wurtz | 366/85 |
| 4,744,669 | 5/1988 | Kowalczyk | 366/301 |
| 4,895,688 | 1/1990 | Shigetani | 425/204 |
| 5,083,506 | 1/1992 | Horn | 366/297 |
| 5,230,562 | 7/1993 | Nishimi | 366/300 |

FOREIGN PATENT DOCUMENTS

| | | | |
|---|---|---|---|
| 962746 | 4/1957 | Germany | 425/204 |
| 1045372 | 12/1958 | Germany | 366/300 |
| 1545209 | 6/1971 | Germany | 366/85 |
| 259427 | 12/1985 | Japan | 425/204 |
| 2039764 | 8/1980 | United Kingdom | 366/300 |

*Primary Examiner*—Philip R. Coe
*Assistant Examiner*—Terrence R. Till
*Attorney, Agent, or Firm*—Jack Matalon

[57] ABSTRACT

A back mix, drag-flow apparatus that provides both radial and axial mixing of materials comprising at least two worms in screw form and parallel and tangential to one another that are of opposite hands and are rotatable only in the same direction or are of the same hand and are rotatable only in opposite directions; and a barrel casing completely enclosing said worms and containing a feed inlet and a product outlet.

6 Claims, 8 Drawing Sheets

BACK MIX DRAG-FLOW APPARATUS invention relates to a back mix, drag-flow apparatus that provides both radial and axial mixing of materials. The apparatus is useful for continuous-flow processes, especially bulk homopolymerization and copolymerization processes.

Backmixing in continuous-flow reactors can significantly alter the outcome of chemical reactions carried out therein, particularly the selectivity as well as the yield of the desired reaction products. Conventional back mix drag-flow reactors are typically equipped with agitators in order to generate convective mixing in all directions, especially longitudinal, but transverse as well; such back mix reactors are consequently limited to those reaction processes which may proceed at relatively low viscosity. The most common example of such type of reactor is the continuous stirred tank reactor ("CSTR"), see K. G. Denbigh, Trans. Faraday Soc., 43, 648 (1947).

CSTRs can produce chain addition polymers with narrower molecular weight distributions than plug-flow reactors, as well as copolymers with narrower composition distributions. This is reported to be the result of spatially and temporally uniform concentrations and temperatures which all reactants experience as they pass through the CSTR under steady state conditions, see J. A. Biesenberger and D. H. Sebastian, "Principles of Polymerization Engineering" John Wiley & Sons, Inc., New York (1983).

Conversely, CSTRs are reported (J. A. Biesenberger, et al., ibid.) to be capable of producing stepwise polymers with molecular weight distributions broader than those obtainable in plug-flow reactors. This is stated to be a consequence of all growing molecules having equal probability of terminating growth by random physical removal from the reaction vessel in the effluent stream.

The apparatus of the present invention utilizes back mixing as well as drag-flow. As a result, the apparatus of the present invention may be used to carry out bulk reactions, i.e. reactions such as homopolymerization and copolymerization reactions in which there is little or no solvent or diluent present, notwithstanding that such reactions produce high reaction viscosities which are poorly handled with prior art reactors.

In its broadest sense, the present invention relates to a back mix, drag-flow apparatus which provides both radial and axial mixing of materials and comprises:

(a) at least two worms in screw form and parallel and tangential to one another that: (i) are of opposite hands and are rotatable only in the same direction or (ii) are of the same hand and are rotatable only in opposite directions; and (b) a barrel casing completely enclosing said worms and containing a feed inlet and a product outlet.

The worms may be single, double or triple start, i.e. single, double or triple flighted. Although the relationship between the hands of the worms and the rotational direction must be maintained as set forth above, the pitches of the worms may independently range from about 0.25 D to 5.0 D, preferably 0.5 D to 2.0 D (corresponding to helix angles of about 5° to 60°, preferably 9° to 32°). The rotational speed of each worm may independently vary in the range of about 3 to 600 rpm, preferably 10 to 200 rpm.

The basic requirement of the apparatus of the present invention is that in order to insure proper back mixing, the drag-flow of one worm must operate in the direction opposite that of the drag-flow of the other worm. The drag-flows of the worms need not be equal; unequal drag flows can be achieved by a difference in pitch and/or in rotational speed.

The length-to-diameter ratios of the worms may independently vary over a wide range, i.e. from about 4 to 40. Higher L/D ratios provide greater surface-to-volume ratios which are desirable if maximum heat transfer through the casing walls is desired. On the other hand, lower L/D ratios favor environments which approach complete back mixing.

If it is desired to provide for devolatilization of vaporizable constituents, e.g. removal of reaction by-products, reflux cooling by allowing a portion of the reaction mass to vaporize, the forward drag-flow should preferably exceed the back drag-flow to permit a partially starved zone from which vapor can evolve.

The apparatus of the present invention utilizes the counter-posed drag flows to provide rapid and thorough axial mixing, while retaining the fully accessible worm-to-worm intermixing to provide the desired homogenization. Furthermore, there need be only one worm extended into the product discharge zone, a feature well known in respect to counter-rotating, non-intermeshing twin screw extruders.

Preferably, a two-worm version of the apparatus of the present invention will include (a) a counter-flow zone disposed between a feed inlet zone and a product discharge zone; and (b) a first and a second worm which have opposite hands throughout the counter-flow zone and are rotatable only in the same direction;

(c) the second worm has the same hand throughout the feed inlet, counter-flow and product discharge zones; and (d) the hands of the first worm are the same throughout the feed inlet and product discharge outlet zones and are opposite to the hand present in the counter-flow zone.

An alternative variation of the above-described preferable two-worm version comprises:

(a) a counter-flow zone disposed between a feed inlet zone and a product discharge zone; and (b) a first and a second worm which have the same hands throughout the counter-flow zone and are rotatable only in opposite directions;

(c) the second worm has the same hand throughout the feed inlet, counter-flow and product discharge zones; and (d) the hands of the first worm are the same throughout the feed inlet and product discharge outlet zones and are opposite to the hand present in the counter-flow zone.

The apparatus of the present invention may also contain four, rather than two, worms. Moreover, as will be described in greater detail with reference to the accompanying drawings, the four worms may be arranged alongside one another, i.e. in the same plane, or may be nested such that two worms are arranged alongside one another and the remaining two worms are arranged therebelow.

The four-worm version of the apparatus of the present invention comprises:

(a) first, second, third and fourth worms in screw form, wherein:

(i) the first and second worms are parallel to one another, have the same hand and the screw flights thereof are staggered such that the first and second worms intermesh with one another and are co-rotatable only in the same direction;

(ii) the third and fourth worms are parallel to one another, have the same hand which is opposite to the hand of the first and second worms, and the screw flights of the third and fourth worms are staggered such that the third and fourth worms intermesh with one another and are co-rotatable only in the same direction as that of the first and second worms; and (iii) the second and third worms are parallel and tangential to one another; and (b) a barrel casing completely enclosing the first, second, third and fourth worms and containing a feed inlet and a product outlet.

Preferably, the four-worm version of the present invention will include:

(a) a counter-flow zone disposed between a feed inlet zone and a product discharge zone; and (b) the third and fourth worms have the same hands throughout the feed inlet, counter-flow and product discharge zones;

(c) the second and third worms have opposite hands throughout the counter-flow zone; and (d) the hands of the first and second worms are the same throughout the feed inlet and product discharge zones and are opposite to their hands present in the counter-flow zone.

Alternatively, the four-worm version of the apparatus of the present invention comprises:

(a) first, second, third and fourth worms in screw form wherein:

(i) the first and second worms are parallel to one another, have the same hand and the screw flights thereof are staggered such that the first and second worms intermesh with one another and are co-rotatable only in a given direction;

(ii) the third and fourth worms are parallel to one another, have the same hand as that of the hand of the first and second worms, and the screw flights of the third and fourth worms are staggered such that the third and fourth worms intermesh with one another and are co-rotatable only in a direction opposite that of the first and second worms; and (iii) the second and third worms are parallel and tangential to one another; and (b) a barrel casing completely enclosing the first, second, third and fourth worms and containing a feed inlet and a product outlet.

Preferably, the alternative four-worm version will include:

(a) a counter-flow zone disposed between a feed inlet zone and a product discharge zone; and (b) the third and fourth worms have the same hands throughout the feed inlet, counter-flow and product discharge zones;

(c) the first and second worms have the same hands throughout the counter-flow zone as that of the third and fourth worms; and (d) the hands of the first and second worms are the same throughout the feed inlet and product discharge zones and are opposite to their hands present in the counter-flow zone.

It is to be understood that the features described above for the two-worm version, e.g. pitch ranges, rotational speed ranges, length-to-diameter ratio ranges, etc., apply as well to the four-worm version.

Further aspects of the invention will appear from the following specification taken in connection with the accompanying drawings in which FIG. 1 is an elevation view of a counter-rotating two-worm version of the apparatus of the present invention;

Figure 4:
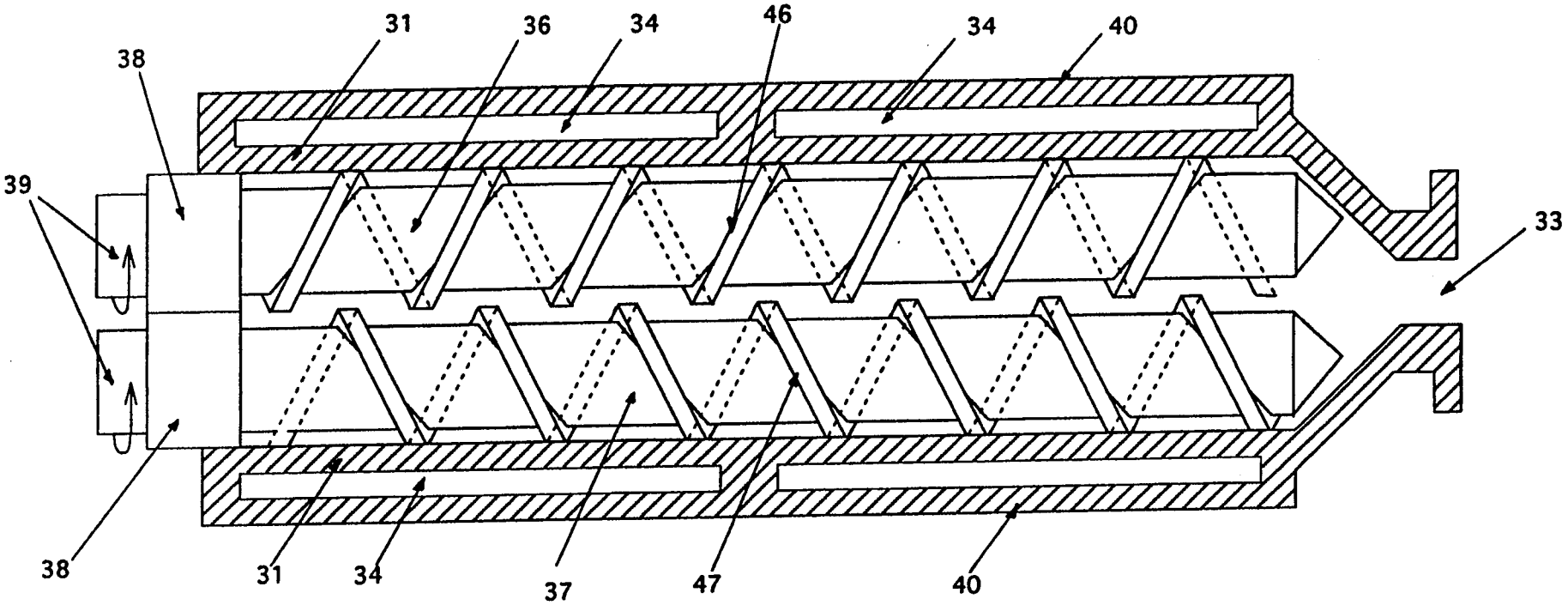
Figure 5:
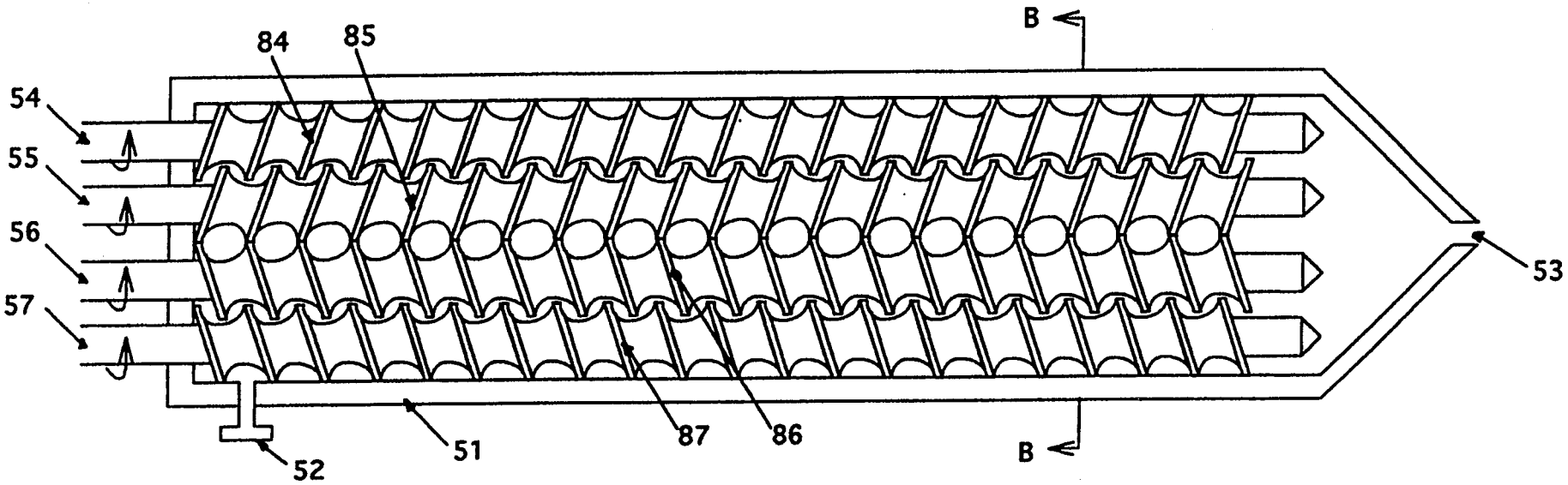
Figure 6:
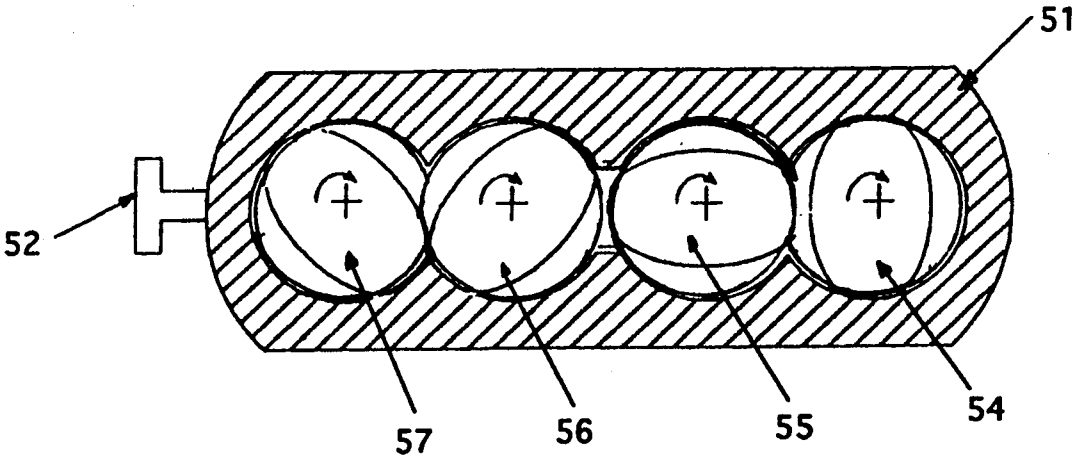
Figure 7:
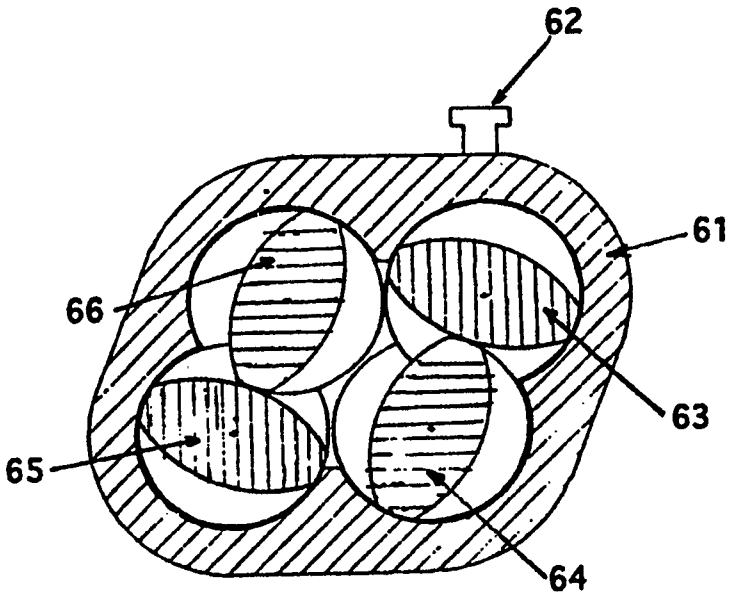
Figure 8:
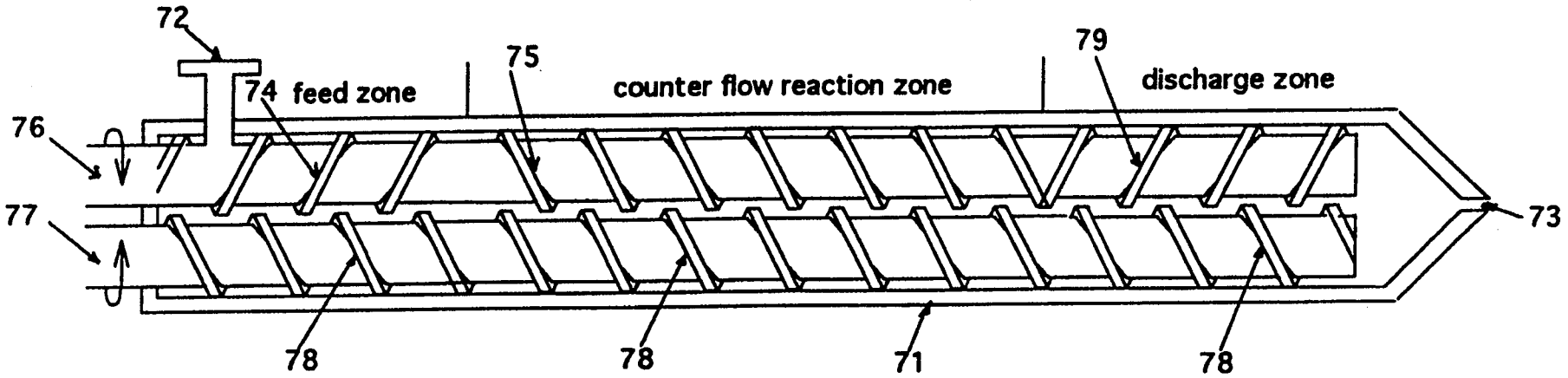

FIG. 4 is a cross sectional plan view of a co-rotating two-worm version of the apparatus; FIG. 5 is a cross sectional plan view of a four-worm version of the apparatus in which the four worms are arranged alongside one another in the same plane; FIG. 6 is a cross sectional end view taken along line B—B of FIG. 5;

FIG. 7 is a cross sectional end view of a four-worm version of the apparatus in which the four worms are arranged in a nested manner;

FIG. 8 is a plan view of a two-worm version of the apparatus incorporated into a typical extruder.

Figure 1:
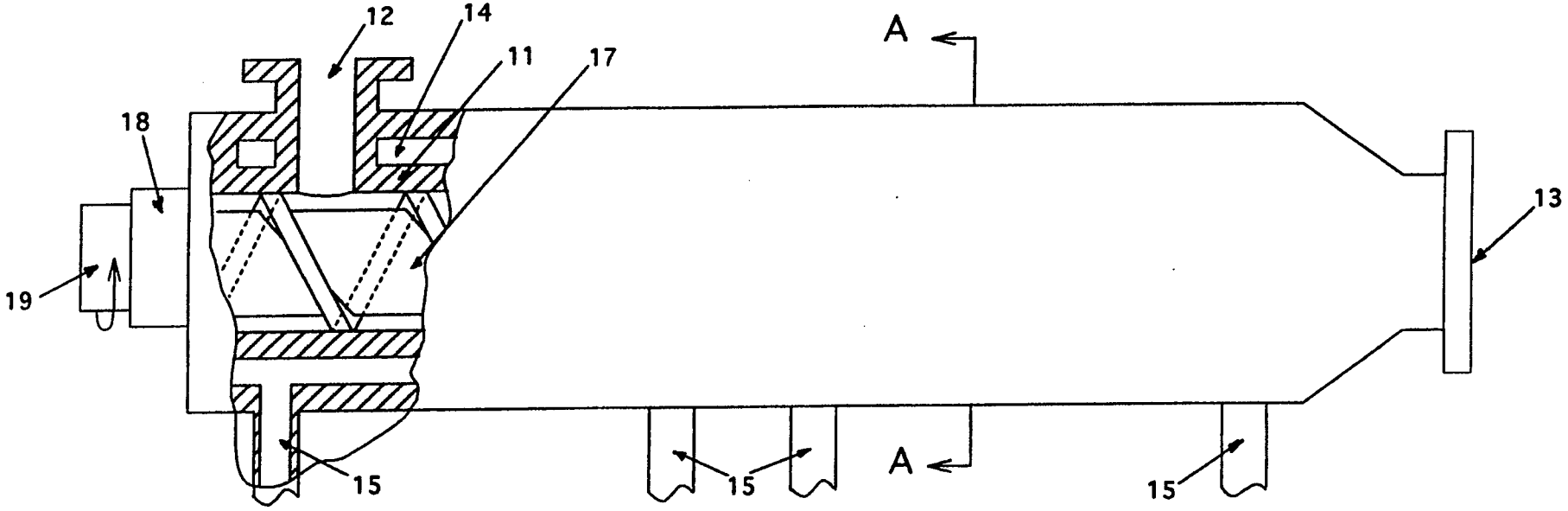
Figure 2:
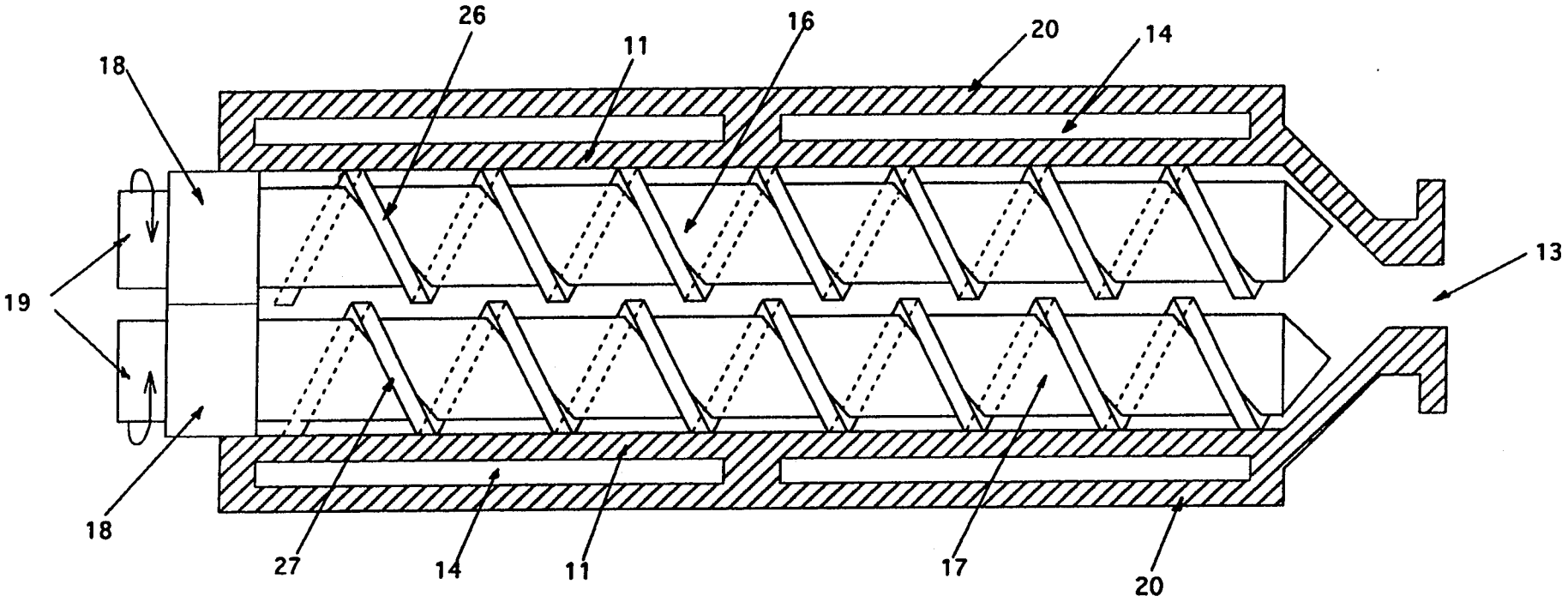
FIG. 2 is a cross sectional plan view of FIG. 1.
Figure 3:
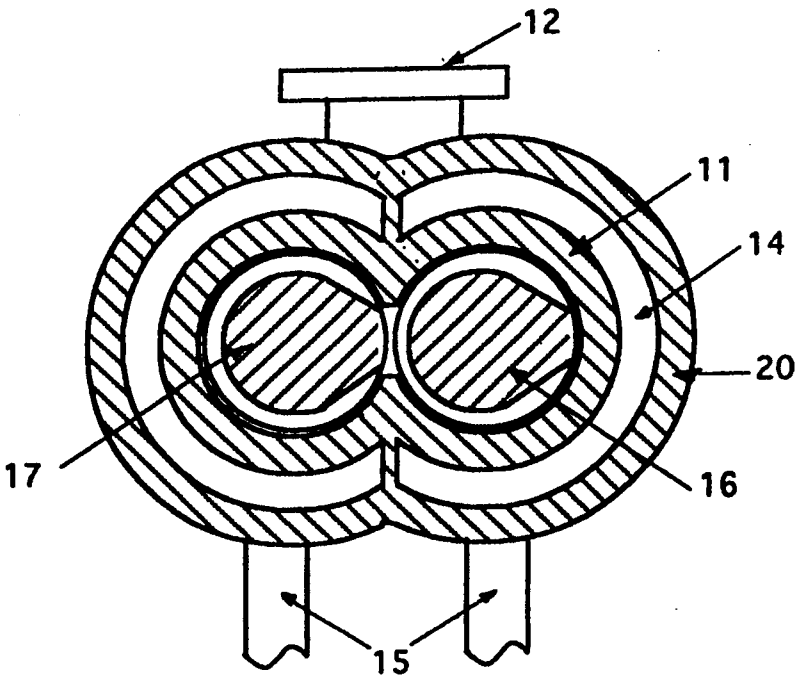
FIG. 3 is a cross sectional end view taken along line A—A of FIG. 1.

In the apparatus of FIGS. 1 TO 3, a barrel casing or housing 11 is formed of a suitable material such as an alloy of steel. Housing 11 is shown in a FIG. 8 shape, but need not be limited to such shape (other shapes such as oval, cylindrical, etc. may also be used). Housing 11 contains a feed inlet 12 and a product outlet 13, as well as a jacket chamber 14 having an outer shell 20 for use with an appropriate heat transfer fluid. Heat transfer fluid inlet and outlet conduits 15 communicate with jacket chamber 14 which may also contain other typical auxiliaries such as temperature gauges, thermocouples, pressure gauges, sampling ports, etc. which are not shown. Right-handed worms 16 and 17 rotating clockwise and counter-clockwise, respectively, from the drive end, are positioned within housing 11.

Screw flights 26 and 27 of worms 16 and 17 must be of the same hand and worms 16 and 17 must rotate in opposite directions in this two-worm version of the apparatus. However, the pitches, i.e. helix angles, of screw flights 26 and 27 need not be equal, and the rotational speeds of the worms may differ. Worms 16 and 17 counter-rotate as shown by the arrows indicated on worm shaft ends 19 extending through shaft seals 18 and are coupled to drive mechanisms (which are not shown).

The apparatus shown in FIG. 4 is analogous to that shown in FIGS. 1–3, except that the two worms are of opposite hands, but co-rotate in the same direction. In FIG. 4, a barrel casing or housing 31 is formed of a suitable material such as an alloy of steel. As in the case of the apparatus of FIGS. 1–3, housing 31 is shown in a FIG. 8 shape, but need not be limited to such shape (other shapes such as oval, cylindrical, etc. may also be used).

Housing 31 contains a feed inlet (not shown) and a product outlet 33, as well as a jacket chamber 34 having an outer shell 40 for use with an appropriate heat transfer fluid. Heat transfer fluid inlet and outlet conduits (not shown) communicate with jacket chamber 34 which may also contain other typical auxiliaries such as temperature gauges, thermocouples, pressure gauges, sampling ports, etc. which are not shown.

Worm 36 containing left-handed screw flights 46 and worm 37 containing right-handed screw flights 47 are positioned within housing 31 and co-rotate clockwise or counter-clockwise. Although worms 36 and 37 must have opposite-handed screw flights, the pitches of the screw flights may be the same or different, as desired. Furthermore, although worms 36 and 37 co-rotate in the same direction (either clockwise or counter-clockwise), their rotational speeds need not be the same. As shown in FIG. 4, worms 36 and 37 co-rotate counter-clockwise (as seen from the drive end) in the direction of the arrows which are indicated on worm shaft ends 39 which extend through shaft seals 38 and are coupled to appropriate drive mechanisms (which are not shown).

FIGS. 5 and 6 depict a four-worm version of the apparatus of the present invention in which the worms are arranged along side one another in the same plane. Worms 54, 55, 56 and 57 are positioned within housing 51 containing feed inlet 52 and product outlet 53. Screw flights 84 and 85 of worms 54 and 55 are intermeshing and are depicted as being left-handed, while screw flights 86 and 87 of worms 56 and 57 are intermeshing and are depicted as being right-handed (the hands may, of course, be reversed, so long as they maintain their opposite-hand relationship). Note that worm 56 is arranged tangentially with respect to worm 57.

FIG. 7 is a modification of the four-worm apparatus depicted in FIGS. 5 and 6. In FIG. 7, the four worms 63, 64, 65 and 66 co-rotate in the direction shown by the arrows and are arranged in a nested fashion with housing 61 containing feed inlet 62. Worm 63 intermeshes with worm 64 and is tangential to worm 66. Worm 64 intermeshes with worm 63 and is tangential to worm 65 and worm 66. Worm 65 intermeshes with worm 66 and is tangential to worm 64, while worm 66 intermeshes with worm 65 and is tangential to worms 63 and 64. Note that the hand of intermeshing worm pairs 63 and 64 is opposite to that of intermeshing worm pairs 65 and 66.

FIG. 8 depicts a two-worm version of the apparatus of the present invention incorporated into a typical extruder. Worms 76 and 77 counter-rotate and are disposed within housing 71 containing feed inlet 72 and product discharge outlet 73. Worm 77 contains screw flights 78 which are of the same hand (shown right-handed) throughout its entire length (i.e. throughout the three zones shown therein); however, it should be understood that the pitch of screw flights 78 may vary throughout its entire length.

The apparatus/extruder shown in FIG. 8 contains three zones depicted therein: a feed zone, a counter-flow reaction zone (i.e. a back mix zone) and a (product) discharge zone. Throughout the feed zone, the hand of screw flight 74 of worm 76 is opposite to the hand of screw flight 78 of worm 77. Throughout the counter-flow reaction zone, the hand of screw flight 75 of worm 76 is opposite to the hand of screw flight 74, but is of the same hand as that of screw flight 78 of worm 77. Throughout the discharge zone, the hand of screw flight 79 of worm 76 is opposite to the hand of screw flight 75, and is opposite to the hand of screw flight 78 of worm 77. It should be understood that the pitches of screw flights 74, 75 and 79 may be different and may also differ from the pitches of screw flights 78. Moreover, the rotational speeds of worms 76 and 77 may be different.

Although several specific configurations of the apparatus of the present invention have been shown for illustrative purposes, it should be understood that modifications well known in the art pertaining to multi-screw extruders may be made to the present invention without departing from the spirit thereof. For example, the apparatus may be equipped with ports for liquid or solid additives, devolatilization, pressure release, sampling, viewing, etc. In addition, the apparatus may be equipped with temperature and/or pressure gauges, thermocouples, dies at the discharge zone, etc. The scope of the apparatus of the present invention is limited solely by the claims which follow.

What is claimed is:

1. A back mix, drag-flow apparatus that provides both radial and axial mixing of materials comprising:

(a) only a first and second worm in screw form and parallel and tangential to one another, with the axial drag-flow conveying direction of one worm being opposite to the axial drag-flow conveying direction of the other worm; and (b) a barrel casing completely enclosing said worms and containing a feed inlet and a product outlet, and including a counter-flow zone disposed between a feed inlet zone and a product discharge zone, said worms having opposite hands throughout the counter-flow zone and being rotatable only in the same direction, the second worm having the same hand throughout the feed inlet, counter-flow and product discharge zones, and the hands of the first worm being the same throughout the feed inlet and product discharge zones and are opposite to the hand present in the counter-flow zone.

2. The apparatus of claim 1 wherein the worms independently have pitches in the range of about 0.25 D to 5.0 D.

3. The apparatus of claim 1 wherein the worms independently have length-to-diameter ratios in the range of about 4 to 40.

4. A back mix, drag-flow apparatus that provides both radial and axial mixing of materials comprising:

(a) only a first and a second worm in screw form and parallel and tangential to one another, with the axial drag-flow conveying direction of one worm being opposite to the axial drag-flow conveying direction of the other worm; and (b) a barrel casing completely enclosing said worms and containing a feed inlet and a product outlet, and including a counter-flow zone disposed between a feed inlet zone and a product discharge zone, said worms having the same hands throughout the counter-flow zone and are rotatable only in opposite directions, the second worm having the same hand throughout the feed inlet, counter-flow and product discharge zones, and the hands of the first worm being the same throughout the feed inlet and product discharge zones and are opposite to the hand present in the counter-flow zone.

5. The apparatus of claim 4 wherein the worms independently have pitches in the range of about 0.25 D to 5.0 D.

6. The apparatus of claim 4 wherein the worms independently have length-to-diameter ratios in the range of about 4 to 40.

* * * * *